United States Patent [19]

Ragone

[11] 3,940,128

[45] Feb. 24, 1976

[54] EXERCISING APPARATUS

[75] Inventor: Bernardo P. Ragone, Lido Beach, N.Y.

[73] Assignee: Vitamaster Industries, Inc., Brooklyn, N.Y.

[22] Filed: Jan. 6, 1975

[21] Appl. No.: 538,604

[52] U.S. Cl. ..... 272/73

[51] Int. Cl.[2] ..... A63B 23/04

[58] Field of Search ..... 272/73, 53.1; 128/25 R

[56] References Cited

UNITED STATES PATENTS

| | | | |
|---|---|---|---|
| 3,062,204 | 11/1962 | Stefano | 272/73 X |
| 3,134,378 | 5/1964 | Harwood | 272/73 X |

FOREIGN PATENTS OR APPLICATIONS

| | | | |
|---|---|---|---|
| 132,504 | 5/1949 | Australia | 272/73 |

*Primary Examiner*—Richard J. Apley
*Assistant Examiner*—T. Brown
*Attorney, Agent, or Firm*—Ryder, McAulay, Fields, Fisher & Goldstein

[57] ABSTRACT

An exercising apparatus of the type simulating a pedaled vehicle wherein a pair of upright posts are mounted on a frame for respectively supporting a handlebar and seat. Drive means are mounted on the frame, and linkage means are provided for connecting the drive means to one of said posts, and for connecting said posts together for conjoint pivotal movement. The arrangement is such that rotation of the drive means causes the posts to oscillate together in the same directions and in substantially parallel relation throughout a cycle of operation of said apparatus.

19 Claims, 4 Drawing Figures

EXERCISING APPARATUS

BACKGROUND OF THE INVENTION

1. Field of the Invention

This invention relates generally to an exercising apparatus and, more particularly, to a simulated pedaled vehicle wherein the posts respectively supporting the handlebar and seat oscillate together in the same directions in substantially parallel relation throughout a cycle of operation of said apparatus.

2. Description of the Prior Art

Heretofore, it has been proposed to construct a bicycle-type exercising apparatus wherein a pair of upright posts are mounted on a frame for respectively supporting the handlebar and seat. Pedaled drive means and extensive, complicated linkage means are provided for operatively interconnecting the drive means with the posts to effect movement of the handlebar and seat toward and away from each other, in scissor-like action, to maximize the extent of body movement during the exercising activity. This converging and diverging relative movement of the posts has a tendency to jam in view of the forces exerted during operation of the apparatus, particularly in light of the extensive linkage interconnecting the various components of the apparatus.

The jamming tendency of the drive means, which is transmitted to the posts during the scissor-like movements, exert unnecessary and undesirable forces on the person using the apparatus which present a safety hazard during the exercising activity. For example, the tendency for the apparatus to jam is more likely to occur when the pedaled drive means is rotatably driven at higher revolutions, during which time, the person is more apt to lose his balance and overturn the apparatus.

The present invention substantially reduces the jamming tendency of known bicycle-type exercising vehicles by providing a structure which effects conjoint pivotal movement of the handlebar post and seat post to cause said posts to oscillate together in the same directions, rather than in scissor-like motion, and in substantially parallel relation throughout a cycle of operation.

Accordingly, an object of the present invention is to provide a simulated bicycle-type pedaled vehicle which is smooth in operation to substantially reduce the likelihood of jamming during the exercising activity.

Another object and feature of the present invention is to provide a bicycle-type exercising apparatus having a relatively simple linkage connection between the drive means and the posts respectively supporting the handlebar and seat; whereby said posts are connected together for conjoint pivotal movement.

A further object and feature of the present invention is to provide an improved exercising apparatus of the type simulating a pedaled vehicle which is relatively inexpensive to manufacture, simple to use and safe in operation.

SUMMARY OF THE INVENTION

The exercising apparatus of the present invention provides for a pair of posts each pivotally mounted on a frame in a substantially upright position. The frame includes a pair of substantially U-shaped side members each having leg portions and an interconnecting portion connecting the leg portions together. Fastening means are provided for locating said side members in laterally spaced relation with the posts pivotally mounted therebetween. Bracing means are also provided extending between and connecting the leg portions of each one of said frame members.

A handlebar is adjustably mounted on one of said pair of posts and a seat is adjustably mounted on the other one of said pair of posts. A pair of differently sized sprockets are rotatably mounted on the frame between said side members, and a chain serves to connect said sprockets together for conjoint rotation.

The apparatus further includes first and second linkage means interconnecting said posts and sprockets to effect conjoint pivotal movement of said posts during the exercising activity. In this regard, a ring is eccentrically mounted on the larger one of said differently sized sprockets for conjoint rotation therewith. The first linkage means has one end portion terminating in a collar member slideably mounted on the ring, and the opposite end portion pivotally connected to the lower end of the post associated with the handlebar. A locking plate serves to prevent the collar from disengaging from the ring upon rotation of the sprockets. The second linkage means has one end portion connected to the lower end of the post associated with the seat and the opposite end portion connected to the lower end of the post associated with the handlebar.

Each one of said differently sized sprockets has a fixed shaft passing therethrough with opposite end portions of each shaft being journaled in respective bearings mounted within the bracing means of said frame members. The opposite shaft end portions of the smaller one of said differently sized sprockets extend outwardly beyond the associated bracing means and pedal means are connected to each extended shaft end portion. In operation, rotation of said pedal means serve to rotate said sprockets which, by means of the interconnecting linkage, causes said posts to oscillate together in the same directions and in substantially parallel relation throughout a cycle of operation of said apparatus.

Additional features and advantages of the present invention will become more apparent from a consideration of the following detailed description when taken in conjunction with the accompanying drawings.

DESCRIPTION OF THE PREFERRED EMBODIMENT

Figure 1:
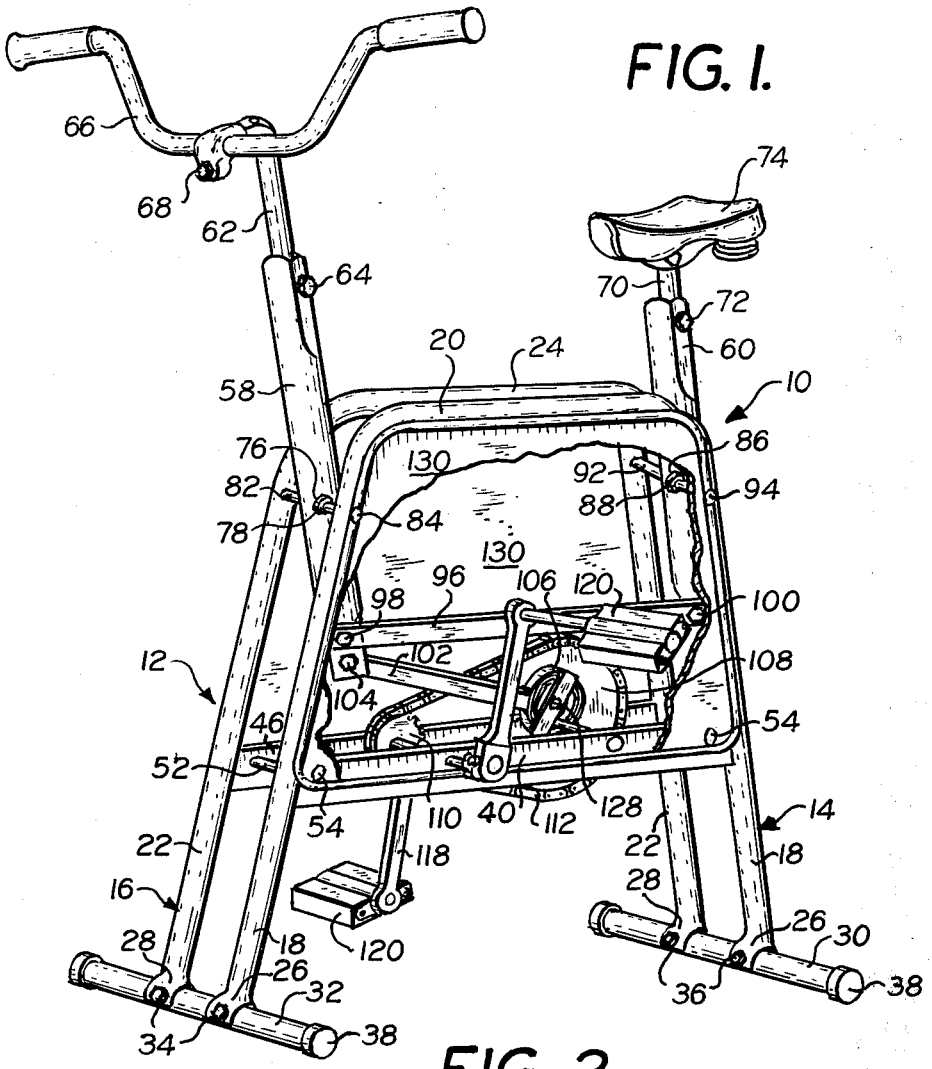
FIG. 1 is a perspective view, with parts broken away, of the exercising apparatus constructed in accordance with the present invention.

Referring to the drawings, numeral 10 represents an exercising apparatus constructed in accordance with the present invention. Apparatus 10 includes a frame 12 which is formed of a pair of substantially U-shaped side members 14 and 16, respectively. Frame member 14 is formed having leg portions 18, 18 and an intermediate portion 20 connecting the leg portions together. Similarly, frame member 16 is formed having leg portions 22, 22 and an intermediate portion 24 connecting said leg portions together. Frame members 14, 16 are located in laterally spaced relation with the corresponding leg end portions 18, 22 in juxtaposed position. As will become hereinafter more apparent, fastening means are provided for maintaining said frame members in said spaced relationship.

Frame members 14 and 16 are preferably tubular and constructed of suitable metal; however, the shape and construction as indicated are merely illustrative and are not to be deemed limitations on the present invention.

Each leg portion 18 terminates in a bifurcated end portion 26 and each leg portion 22 terminates in a bifurcated end portion 28. Each of said bifurcated portions 26, 28 having a pair of aligned openings extending through opposed surfaces thereof as illustrated in FIG. 2. A pair of cross leg members 30 and 32 are provided, each received within a separate pair of juxtaposed bifurcated leg end portions 26, 28. Each of said cross leg members 30, 32 is preferably tubular and is constructed of suitable metal having a pair of laterally spaced through openings (not shown) each extending transverse to the axis of said tubular member. The cross leg members 30, 32 are located with each one of the through openings thereof aligned with a separate pair of the aligned openings in said bifurcated portions. A bolt 34 having an enlarged head is inserted in each of said aligned openings and has its threaded end extending beyond the opening to receive a washer and nut in conventional manner, as represented generally by numeral 36 in FIG. 1. The arrangement is such that the opposite end portions of each of said cross leg members 30, 32 project outwardly beyond frame members 14, 16 to provide a support for frame 12. A plastic or rubber protective cap 38 is inserted on each one of the end portions of said cross leg members 30, 32 for safety purposes.

Extending between and connecting the frame leg portions 18 is a brace member 40 having a plurality of laterally spaced through openings 42 and an additional set of enlarged laterally spaced through openings 44. Another brace member 46 similarly extends between and connects the frame leg portions 22; said brace member 46 also having a plurality of laterally spaced through openings 48 and an additional set of enlarged laterally spaced through openings 50. The opposite ends of each of said brace members 40, 46 are suitably connected to the respective frame leg portions 18, 22 such as by welding or the like. The brace members 40, 46 are located with openings 42 aligned with openings 48 and with enlarged openings 44 aligned with enlarged openings 50.

Fastening means, in the form of a plurality of elongated bushings 52 are positioned between the brace members 40, 46 for maintaining the frame members 14, 16 in spaced relation. Each bushing 52 has threaded opposite end portions received within a separate pair of aligned openings 42, 48. The fastening means further include a plurality of bolts 54, each threadedly engaging with an end portion of a separate bushing 52.

Mounted within each of the pairs of aligned openings 44, 50 is a bearing member 55 for cooperating with the drive means of exercising apparatus, 10 as hereinafter more fully noted in connection with the description of said drive means.

Each one of the leg portions 18, 18 is formed having a through opening 56 and each one of the leg portions 22 is formed having a through opening 57. The spaced relationship between said leg portions 18, 22 is such that each leg opening 56 is aligned with a separate leg opening 57 to provide the basis for pivotally supporting a handlebar post and seat post in the manner hereinafter described.

In accordance with the invention, a pair of laterally spaced posts 58 and 60 are each pivotally mounted on frame 12 in substantially upright position. Posts 58, 60 are preferably each tubular having open upper ends for receiving handlebar means and seat means, respectively. In this connection, a handlebar stem 62 has one end adjustably received in the upper swaged end of post 58, and is conventionally locked in position by means of interengaging bolts and nuts represented generally by numeral 64. The other end of stem 62 adjustably supports a handlebar 66 in conventional manner, which handlebar is locked in position by an interengaging bolt and nut represented generally by numeral 68. A seat stem 70 has one end adjustably received in the upper swaged end of post 60 and is locked in position by means of an interengaging bolt and nut represented generally by numeral 72. The other end of stem 70 supports a seat 74 in conventional manner.

Post 58 is formed having a through opening 76 located intermediate its opposite ends. The post is located between side frame members 14, 16 with opening 76 aligned with one pair of the aligned leg portion openings 56, 57. A sleeve member 78 extends through post opening 76 and serves as a spacer having ends projecting outwardly from opposite sides of post 58. Alternatively, instead of providing a one-piece sleeve 78 extending through the post opening, it will be appreciated that a separate sleeve member could be suitably connected to the opposite sides of post 58, each having an end projecting toward the adjacent leg portion of the frame. A bearing or bushing 80 is received in each end of sleeve 78 and an elongated bushing 82 is inserted through post opening 76, sleeve 78 and bearings 80. The opposite ends of bushing 82 are received in the aligned frame leg openings 56, 57, and a bolt 84 is inserted through each one of said leg openings and threadedly engages with a separate end of bushing 82. Thus, bushing 82 serves as a pivot pin about which post 58 is free to pivot or oscillate in a plane substantially parallel to the planes defined by side frame members 14, 16.

Post 60 is also located between side frame members 14, 16 and is similarly formed having a through opening 86 intermediate its opposite ends. Post opening 86 is aligned with the other pair of aligned leg portion openings 56, 57. A sleeve member 88, similar to sleeve member 78, extends through post opening 86 and a bearing 90 is received in each end thereof. An elongated bushing 92, similar to bushing 82, is inserted through post opening 86, sleeve 88 and bearings 90, with the opposite ends of said bushing received in the aligned frame leg openings 56, 57. A bolt 94 is inserted through each one of said leg openings and threadedly engages with a separate end of bushing 92. The arrangement is such that post 60 is also mounted for pivotal movement about bushing or pivot pin 92 and is free to pivot or oscillate in a plane corresponding to the plane in which post 58 pivots.

The invention further provides for the posts 58, 60 to oscillate together in the same directions and in substantially parallel relation throughout a cycle of operation of the apparatus. This is achieved by providing linkage means represented by link 96 having one end pivotally connected to the lower flatened end of post 58 by means of pivot pin 98, and the opposite end pivotally connected to the lower flatened end of post 60 by means of pivot pin 100. Link 96 thus serves to connect post 58, 60 together for conjoint pivotal movement. Another link 102 is provided having one end pivotally connected to the lower flatened end of post 58 by means of pivot pin 104. The arrangement is such that pivot pin 104 is located below pivot pin 98 for smooth operation of the apparatus. The other end of link 102 terminates in a collar member 106 which is connected to the drive means of exercising apparatus 10 in the manner hereinafter described.

The drive means for effecting pivotal movement of posts 58, 60 by means of links 96, 102 comprise a pair of laterally spaced differently sized sprockets 108, 110 rotatably mounted on frame 12 and interconnected by chain 112 for conjoint rotation. The sprockets are located between side frame members 14, 16 in the region between bracing members 40, 46. Sprockets 108, 110 are each formed with a centrally located through opening through which passes mounting shafts 114 and 116, respectively. Shafts 114, 116 are fixedly connected to their associated sprockets, such as by welding or the like, for conjoint rotation therewith. The opposite end portions of shaft 114 are each journaled in a bearing 55 mounted within one of the pair of aligned openings 44, 50 in bracing members 40, 46. The opposite end portions of shaft 116 are similarly each journaled in a bearing 55 mounted within the other one of the pair of aligned openings 44, 50 in said bracing members. In the preferred embodiment, the opposite end portions of shaft 114 project outwardly from larger sprocket 108 whereas the opposite end portions of shaft 116 project outwardly from smaller sprocket 110.

Pedal means are provided for rotating the drive means during the exercising activity. In this regard, the opposite end portions of shaft 116 each extend outwardly beyond the associated bracing members 40, 46, and fixedly receive the end of a pedal crank 118 thereon. The other end of each crank 118 is connected to a rotatably mounted pedal 120 in conventional manner.

Figure 3:
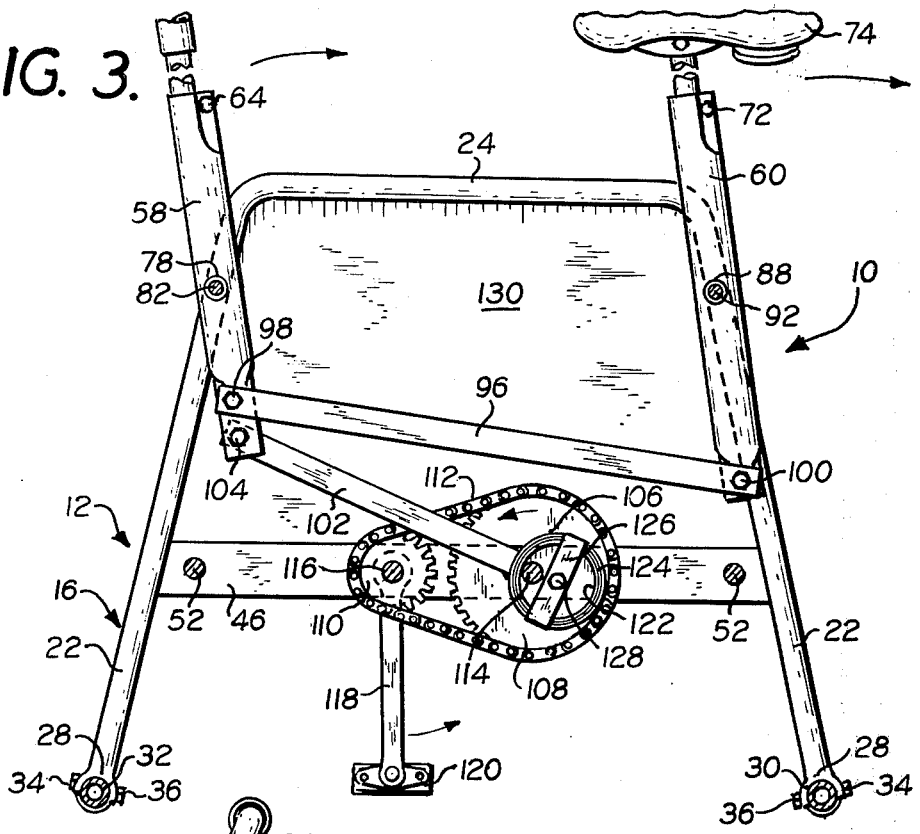
FIG. 3 is a side elevational view, partly in section and with parts broken away, of the exercising apparatus shown in FIG. 1 illustrating the position of the components when the handlebar post and seat post are in their respective forward positions.
Figure 4:
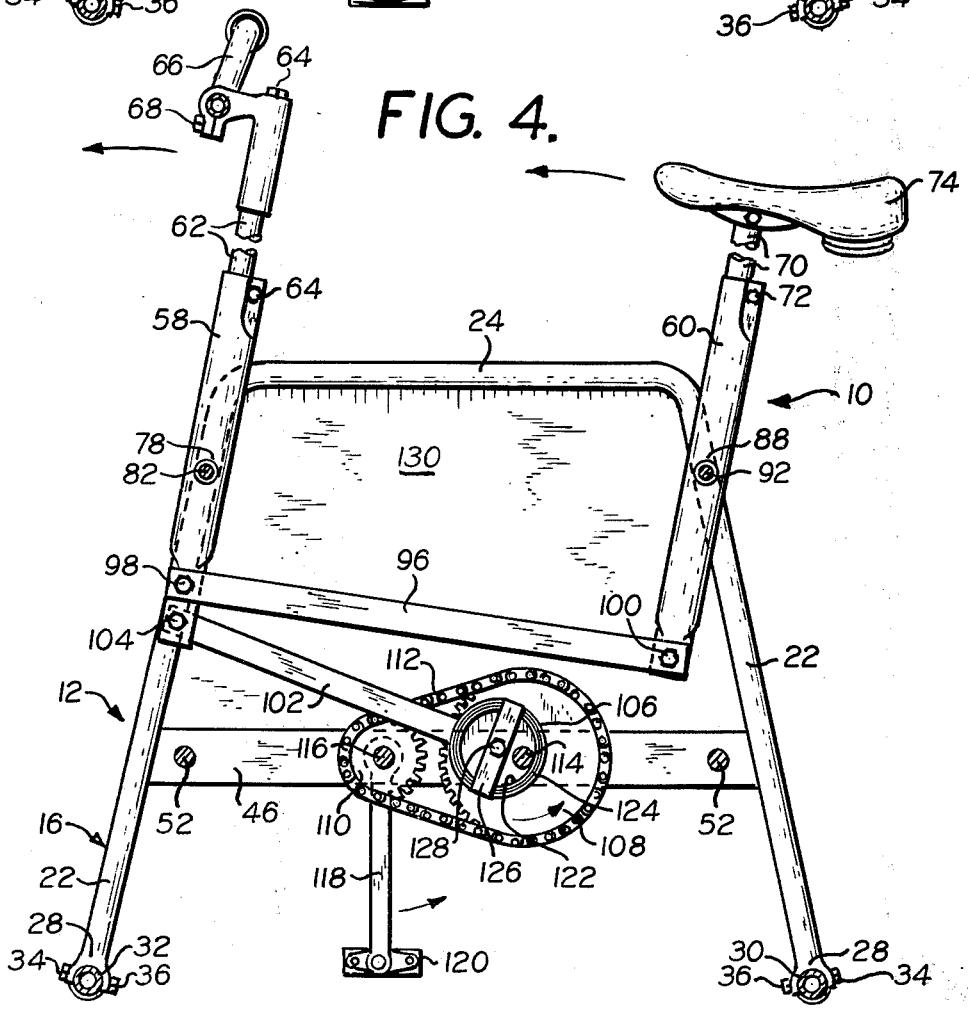
FIG. 4 is a view similar to FIG. 3 illustrating the position of the components when the handlebar post and seat post are in their respective rearward positions.

Projecting outwardly from one side of sprocket 108 is a ring 122 eccentrically mounted on said sprocket for conjoint rotation therewith. Ring 122 is fixedly mounted on sprocket 108 by means of welding or the like. A cam bushing 124 is slid over ring 122 and is free to move relative to rotation of said ring. Link end collar 106 is then slid over cam bushing 124 so as to provide free relative movement between link 102 and sprocket 108. Ring 122 is mounted such that an inner surface portion thereof is also fixedly connected to a surface portion of sprocket shaft 114 by means of welding or the like. The arrangement is such that a force exerted on pedals 120, 120 serves to rotate cranks 118, 118 counterclockwise in the direction of the arrow as viewed in FIGS. 3 and 4, which, in turn, causes connected shaft 116 to similarly rotate. Rotation of shaft 116 causes similar rotation of connected ratchet 110 which drives the larger sprocket 108 counterclockwise in the direction of the arrow as viewed in FIGS. 3 and 4 by means of the interconnecting chain 112. Rotation of sprocket 108 serves to pivotally displace handlebar post 58 by means of interconnecting link 102. Pivotal movement of post 58, in turn, causes seat post 60 to pivotally move by means of interconnecting link 96.

There is thus provided a kinetically integrated structure wherein handlebar post 58 and seat post 60 oscillate together in the same directions and in substantially parallel relation throughout a cycle of operation of said apparatus 10. This is illustrated more clearly in FIG. 3 wherein posts 58, 60 are in their respective forward positions, and in FIG. 4 wherein said posts are in their respective rearward positions.

In order to prevent link collar 106 from inadvertently disengaging from ring 122 upon rotation of the drive means, a removable lock in the form of a plate 126 is mounted in spaced relation to sprocket 108. Plate 126 is formed with an opening through which passes bolt 128 having a threaded end which engages with a complementary threaded opening in the side of ratchet 108. Plate 126 is located with portions thereof in overlying relation to ring 122, cam bushing 124 and link collar 106 to maintain said elements in their nested relationship during operation of the apparatus. In this regard, it will be appreciated that plate 126 has a length greater than the diameter of link collar 106. The mounting position of plate 126 is such that a side edge thereof is in contact with a surface of sprocket shaft 114.

Figure 2:
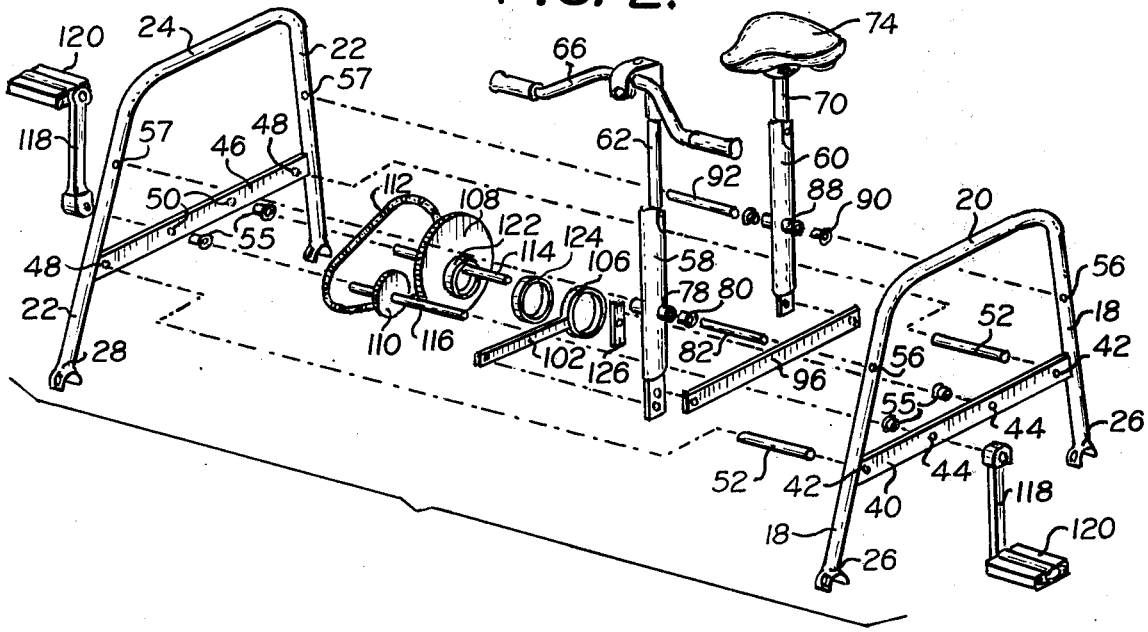
FIG. 2 is an exploded perspective view illustrating the components of the exercising apparatus shown in FIG. 1, with the outer cover panels removed for purposes of clarity.

Upon assembly of the apparatus, an outer panel member 130, shown broken away in FIG. 1, can be mounted on each frame member 14, 16 in substantially overlying relation thereto. Each panel 130 is formed with openings suitably located to receive the fastening bolts 54, 84 and 94 which serve to mount said panels to the frame members. A suitable cut-out is also provided in each of said panels (not shown) to permit passage therethrough of the opposite ends of ratchet shaft 116, which in turn supports the pedal means for rotating ratchet 110.

There is thus provided a novel bicycle-type exercising apparatus which substantially reduces the jamming tendency of heretofore known exercising vehicles which operate in scissor-like motion. The aforesaid structure includes a simple linkage arrangement which enables the handlebar post and the seat post to oscillate together in the same directions and in substantially parallel relation throughout a cycle of operation. The apparatus is constructed of relatively few and inexpensive parts which can be easily assembled for use. The apparatus can be operated at higher revolutions of the drive means without any jamming tendency to thus provide an apparatus that is safer in operation than the heretofore known bicycle-type exercising vehicles.

While a preferred embodiment of the invention has been shown and described in detail, it will be readily understood and appreciated that numerous omissions, changes and additions may be made without departing from the spirit and scope of the present invention.

I claim:

1. An exercising apparatus comprising:

a. a frame;

b. a pair of laterally spaced posts each pivotally mounted on said frame in a substantially upright position, each of said posts having upper and lower end portions;

c. handlebar means mounted on the upper end portion of one of said pair of posts;

d. seat means mounted on the upper end portion of the other one of said pair of posts;

e. drive means rotatably mounted on said frame;

f. a ring eccentrically mounted on said drive means for conjoint rotation therewith;

g. first linkage means having end portions connecting one of said pair of posts to said drive means;

h. one end portion of said first linkage means terminating in a collar member slideably mounted on said ring and the opposite end portion of said first linkage means pivotally connected to the lower end of one of said pair of posts;

i. second linkage means having end portions connecting said post together for conjoint pivotal movement;

j. one end portion of said second linkage means pivotally connected to the lower end of the other one of said pair of posts and the opposite end portion of said second linkage means pivotally connected to the lower end of said one of said pair of posts;

whereby rotation of said drive means causes said posts to oscillate together in the same directions and in substantially parallel relation throughout a cycle of operation of said apparatus.

2. The exercising apparatus as recited in claim 1, wherein said drive means comprises a pair of laterally spaced differently sized sprockets and a chain connecting said sprockets together for conjoint rotation; said ring being eccentrically mounted on the larger one of said differently sized sprockets; and removable lock means mounted on said larger sized sprocket to prevent the collar member from disengaging from the ring upon rotation of said drive means.

3. The exercising apparatus as recited in claim 2, wherein said removable lock means comprises a plate mounted in spaced relation to said larger sized sprocket; said ring and collar member located between said plate and sprocket; and said plate having a portion in overlying relation to said ring and collar member.

4. The exercising apparatus as recited in claim 3, wherein said plate has a longitudinal extent greater than the diameter of said collar member.

5. The exercising apparatus as recited in claim 1, wherein said opposite end portions of said first and second linkage means are each pivotally connected to the lower end of the post associated with the handlebar means; the pivotal connection of said second linkage means being located above the pivotal connection of said first linkage means.

6. The exercising apparatus as recited in claim 5, wherein said opposite end portions of said first and second linkage means are each pivotally connected to the lower end of the post associated with the handlebar means; the pivotal connection of said second linkage means being located above the pivotal connection of said first linkage means.

7. The exercising appartus as recited in claim 1, wherein said frame comprises a pair of side members each having leg portions; fastening means for locating said members in laterally spaced relation; a pair of bracing means each extending between and connecting the leg portions of a separate one of said frame members; one of said bracing means having a first set of through openings and the other one of said bracing means having a second set of through openings; each one of said first set of bracing openings being aligned with a separate one of said second set of bracing openings; a bearing member mounted within each one of said first and second sets of bracing openings; said drive means comprising a pair of laterally spaced differently sized sprockets each supported between said frame members and a chain connecting said sprockets together for conjoint rotation, each one of said sprockets having a central through opening; a shaft extending through each sprocket opening and having opposite end portions each projecting outwardly from said sprocket; means connecting each shaft to its associated sprocket for rotation therewith; the opposite shaft end portions of each one of said sprockets being journaled in a separate pair of said aligned sets of bracing openings; the opposite shaft end portions of one of said sprockets extending outwardly beyond the associated bracing means; and a pair of pedal means for rotating said drive means, each one of said pedal means connected to a separate one of said extended shaft end portions.

8. The exercising apparatus as recited in claim 7, wherein said ring is eccentrically mounted on the larger one of said differently sized sprockets for conjoint rotation therewith; and removable lock means mounted on said larger sized sprocket to prevent the collar member from disengaging from said ring upon rotation of said drive means.

9. The exercising apparatus as recited in claim 8, wherein said ring has an inner surface; the shaft of said larger sized sprocket extending through said ring and in fixed contact with an inner surface portion of said ring.

10. The exercising apparatus as recited in claim 8, wherein said extended shaft end portions extend outwardly from the smaller one of said differently sized sprockets.

11. The exercising apparatus as recited in claim 1, wherein said frame comprises a pair of substantially U-shaped members each having leg portions and an intermediate portion connecting said leg portions together; fastening means for locating said members in laterally spaced relation; the leg portions of one of said frame members having a plurality of first through openings and the leg portions of the other one of said frame members having a plurality of second through openings; each one of said first openings being aligned with a separate one of said second openings; said fastening means comprising a plurality of elongated bushings having threaded end portions; each one of said bushings extending between said frame members with the end portions of each bushing received within a separate pair of said aligned openings; and a plurality of bolts each threadedly engaging with an end portion of a separate one of said bushings.

12. The exercising apparatus as recited in claim 11, wherein each of said posts is located between said frame members and is formed having a through opening; each post opening being aligned with a separate pair of said aligned leg portion openings; spacing means located between said posts and said frame members; said spacing means comprising a pair of sleeve members each having a through opening; each one of said sleeve members extending through a separate post opening and having opposite end portions each projecting outwardly from said post; and each one of said bushings extending through a separate one of said sleeve members.

13. The exercising apparatus as recited in claim 12, further comprising a pair of bracing means each extending between and connecting the leg portions of a separate one of said frame members; each one of said bracing means being located between the intermediate portion and the leg portions of the associated frame member; one of said bracing means having a plurality of first through openings and the other one of said bracing means having a plurality of second through openings; each one of said first bracing openings being aligned with a separate one of said second bracing openings; said fastening means comprising a plurality of additional elongated bushings having threaded end portions; each one of said additional bushings extending between said pair of bracing means with the end portions of each bushing received within a separate pair of said aligned bracing openings; and a plurality of additional bolts each threadedly engaging with an end portion of a separate one of said additional bushings.

14. The exercising apparatus as recited in claim 13, wherein said drive means comprises a pair of laterally spaced differently sized sprockets each supported between said frame members and a chain connecting said sprockets together for conjoint rotation, each one of said sprokets having a central through opening; a shaft extending through each sprocket opening and having opposite end portions each projecting outwardly from said sprocket; means connecting each shaft to its associated sprocket for rotation therewith; one of said bracing means having a first set of additional through openings and the other one of said bracing means having a second set of additional through openings; each one of said first set of bracing openings being aligned with a separate one of said second set of bracing openings; a bearing member mounted within each one of said first and second sets of bracing openings; the opposite shaft end portions of each one of said sprockets being journaled in a separate pair of said aligned sets of bracing openings; the opposite shaft end portions of one of said sprockets extending outwardly beyond the associated bracing means; and a pair of pedal means for rotating said drive means, each one of said pedal means connected to a separate one of said extended shaft end portions.

15. The exercising apparatus as recited in claim 14, wherein said ring is eccentrically mounted on the larger one of said differently sized sprockets for conjoint rotation therewith; and removable lock means mounted on said larger sized sprocket to prevent the collar member from disengaging from said ring upon rotation of said drive means.

16. The exercising apparatus as recited in claim 15, wherein said ring has an inner surface; the shaft of said larger sized sprocket extending through said ring and in fixed contact with an inner surface portion of said ring.

17. The exercising apparatus as recited in claim 15, wherein said extended shaft end portions extend outwardly from the smaller one of said differently sized sprockets.

18. The exercising apparatus as recited in claim 1, wherein said frame comprises a pair of substantially U-shaped members each having leg portions and an intermediate portion connecting said leg portions together, each of said leg portions terminating in an end portion; fastening means for locating said members in laterally spaced relation with the corresponding leg end portions of said members in juxtaposed position; a pair of cross leg members each terminating in end portions; each one of said cross leg members connected to a separate pair of said juxtaposed leg end portions with the ends of each one of said cross leg members projecting outwardly beyond said frame members to provide a support for said frame.

19. The exercising apparatus as recited in claim 18, further comprising a pair of panel members each mounted on a separate one of said frame members in substantially overlying relation thereto.

* * * * *